United States Patent [19]

Chang

[11] Patent Number: 4,768,965

[45] Date of Patent: Sep. 6, 1988

[54] ELECTRICAL CONNECTOR WITH SELECTIVE RECEPTACLES

[76] Inventor: Yen C. Chang, 20, Lane 178, Min-Chu Road, Hsin Chu, Taiwan

[21] Appl. No.: 1,339

[22] Filed: Jan. 8, 1987

[51] Int. Cl.[4] ..... H01R 13/44

[52] U.S. Cl. ..... 439/137; 439/135; 439/651

[58] Field of Search ..... 174/66, 67; 339/36, 339/40, 42, 59 R, 154 R, 154 A, 155 R, 156 R, 156 T, 157 R; 439/135, 136, 143, 145, 586, 560, 593, 599, 638, 639, 650, 651

[56] References Cited

U.S. PATENT DOCUMENTS

| | | | |
|---|---|---|---|
| 2,552,061 | 5/1951 | Popp | 339/36 |
| 3,772,633 | 11/1973 | Danesi | 339/154 R |
| 4,206,957 | 6/1980 | Ludwig et al. | 439/142 |
| 4,279,457 | 7/1981 | Nickence | 339/36 |
| 4,600,258 | 7/1986 | Hu | 439/135 |
| 4,632,479 | 12/1986 | Jacobson | 339/36 |
| 4,729,741 | 3/1988 | Peng | 439/135 |

*Primary Examiner*—Gil Weidenfeld
*Assistant Examiner*—Paula A. Austin
*Attorney, Agent, or Firm*—Bucknam and Archer

[57] ABSTRACT

An electrical connector having a generally cubical housing with a matchable cover, a plurality of plug-in receptacles disposed within the housing, plug-in openings provided on the surfaces of both the housing and the cover while the cover openings are mounted with slidable door each having at least one slot to selectively expose or cover-up the pairs of spaced-apart electrical contact strips embedded in the housing to render the receptacles accessible or to close them.

4 Claims, 5 Drawing Sheets

ELECTRICAL CONNECTOR WITH SELECTIVE RECEPTACLES

The present invention relates generally to electrical connectors having multiple-access receptacles each selectable through a sliding door which may open to expose the electrical contact strip pair for use or close to cover-up otherwise. Multiple-outlet electrical connectors have been known to be able to take a plurality of plug-ins of electrical appliances or the like, to provide such devices without consideration of safety measures and may result in accidental hazards. Other than the one in service, the remaining receptacle openings are supposed to be rendered inaccessible. The means taken in the present invention comprises a sliding door provided with each opening of the individual pairs of the receptacle.

The electrical connector of the present invention comprises a cubical shaped housing of insulating material having a pair of electrical contact strips embedded therein, a matchable cover also of insulating material which closes the top of the housing. The contact strips are inter-connected with a pair of electrical cords which lead to a power source through the end opening of the housing. Alternatively disposed on the housing surface and the cover surface in a spaced-apart manner are a plurality of openings serving as accesses to the plug-in receptacles. Other than the one on the surface of the housing section, the remaining openings on the surface of the cover are each provided with a slidably mounted door which is capable of being opened to take a plug or otherwise to be closed when the service is not required.

Alignment pin and/or rib with corresponding recesses are provided between the housing-and-cover pair to ensure a safely engagement to withstand stresses which may exist when the insertion and the removal of the plug are effected and prevent accidental separation of the connector parts.

In the conventional connections having plug-in receptacles, loose engagement between the plug prongs and the contact strips usually occurs when material fatigue results from the frequent insertion and removal of the plug. The present invention solves this problem in two manners, firstly by providing a sinuous configuration to each contact strip and let the adjacent receptacles dispose at alternate positions respectively on the housing surface and the cover surface so that the movement of the plug may occur in opposite directions to alleviate the single directional material fatigue. Secondly, other than the tongue-like structure of the contacts which gives a better contact between the plug-prongs and the strips, a padding of resilient material like a block of plastic material such as foam rubber and/or a leaf type bias spring reinforces the tongue to reduce the possibility of material fatigue occurrence.

SUMMARY OF THE INVENTION

Therefore it is an object of the invention to provide plug-in receptacles alternatively accessible from opposite sides respectively at a housing surface and a cover surface of the connector.

Another object of the present invention is to provide a contact strip of the receptacle member in a sinuous configuration and accessible alternatively at two opposite sides.

A further object of the present invention to provide a contact strip of the receptacle member with tongue-like structure to have a tighter contact between the incoming plug prong and the strip.

Still another object of the present invention is to provide the contact strip with resilient padding and/or bias spring to reduce the material fatigue of the contact strip.

Still a further object of the present invention is to provide each surface opening of the housing cover with a sliding door with at least one slot to allow the insertion of the plug prong when the door slides open and to render the opening inaccessible when the door is slider close.

Other objects and features of the present invention will become apparent from a detailed description accompanying the annexed drawings.

BRIEF DESCRIPTION OF THE DRAWING

FIGS. **5*a*–5*c* are each an exploded view of this embodiment respectively with resilient padding, bias spring or a combination of both.

DESCRIPTION OF THE PREFERRED EMBODIMENT

Figure 5A:
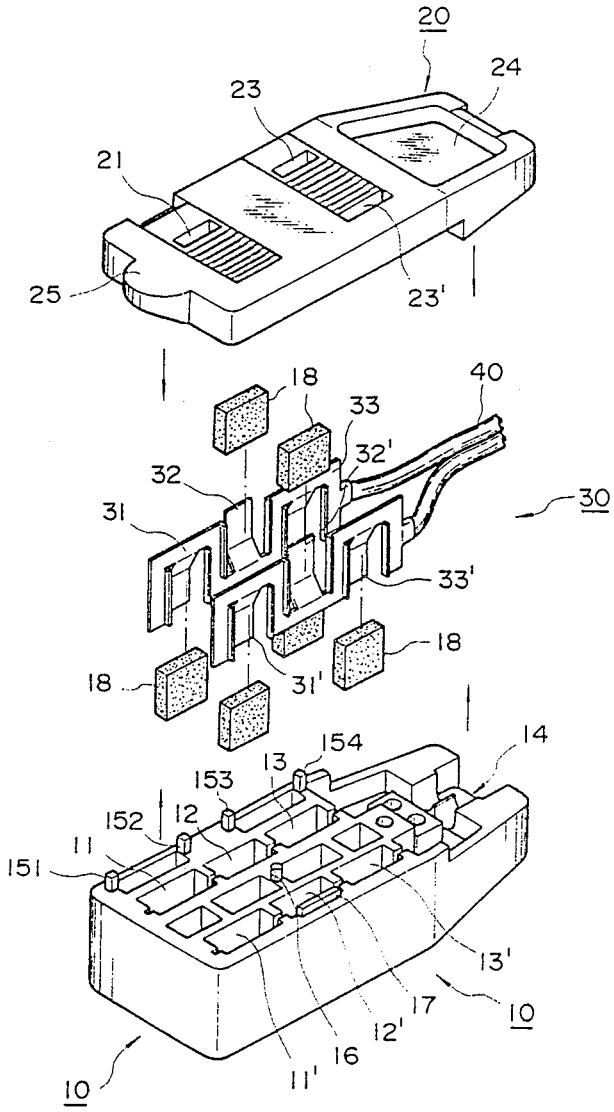
Figure 5B:
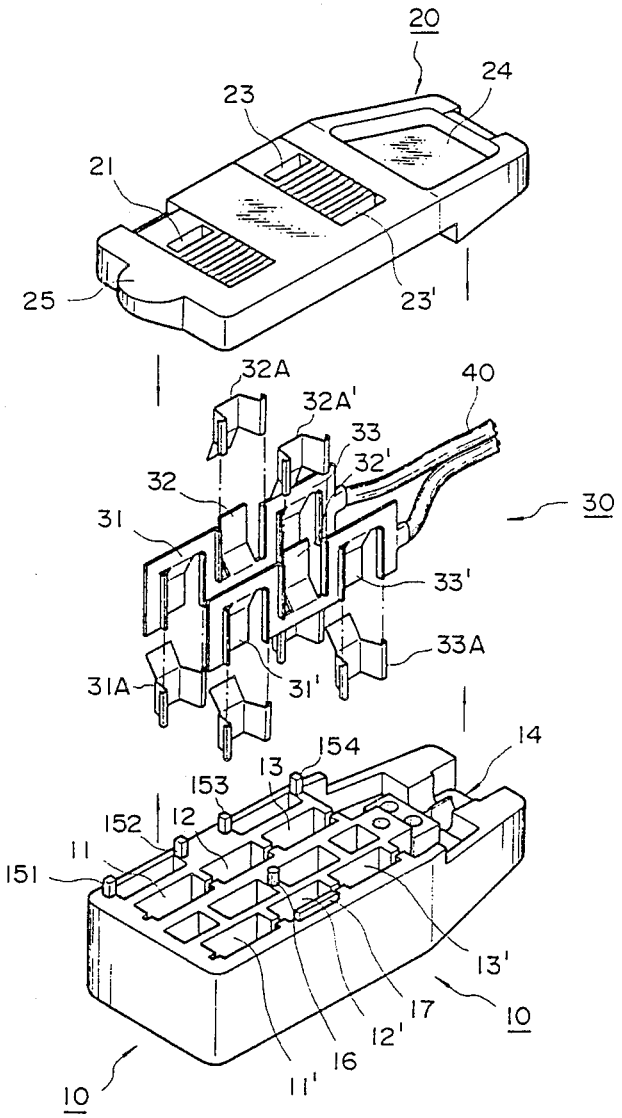
Figure 5C:
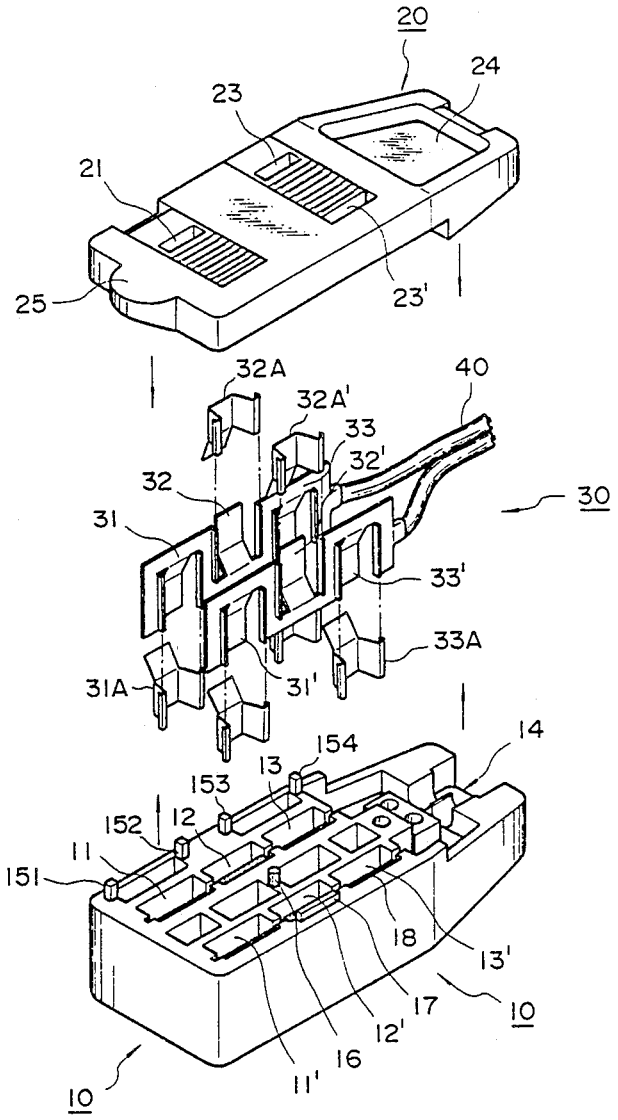

The connector of the present invention is generally in a cubical shape, comprising a housing portion 10 and a matchable cover portion 20 with contact-strip pair 30 embedded in the pits 11-12-13 and 11'-12'-13' provided within the housing 10. Referring to FIGS. 5A-5C, there are many unnumbered pits around, aimed at the reduction of the overall weight of the connector. The two contact-strips 31-32-33 and 31'-32'-33' are connected to a pair of cord 40 led to a power source (not shown). Each contact strip 31-32-33 is formed with a sinuous configuration of three continuous sections 31, 32 and 33, each with a tongue member therein.

Figure 4C:
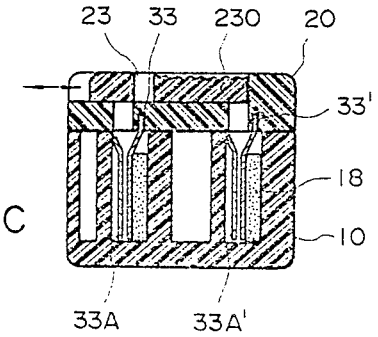
FIGS. 4A–4C, are each a cross sectional view taken along line IV—IV of FIG. 2, showing the provision of either resilient padding, bias spring or a combination of both.
Figure 4A:
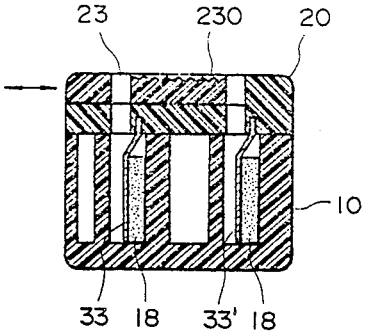
Figure 4B:
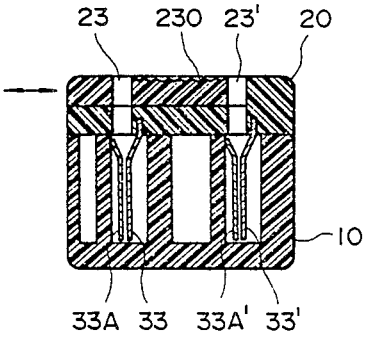

Before being embedded into the pit 11-12-13, there are preplanted in respective pits, bias or reinforcement spring leaves 31A, 32A and 33A (FIG. 5B) to tighten the grip of the incoming plug-prong and to reduce the fatigue of the contact strip, (also see FIGS. 4B–4C). In FIG. 5A, plastic material paddings 18 made for instance of foam rubber are inserted at the back of the strip instead of the bias springs (see also FIG. 4A), while the combination use of both bias springs as well as plastic paddings is shown in the FIGS. 5C and 4C.

Figure 6A:
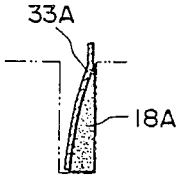
FIGS. 6A, 6B** are cross sectional views showing two variations of padding to further the tightness.

The shape of the plastic padding is not necessarily to be in the form of a rectangular block such as shown in the drawings, which may be of a wedge cross-section 18A such as shown in FIG. 6A, where the tongue 33A of the contact strip is made with a corresponding inclination so that the tightness of the plug-in is greatly improved.

Figure 6B:
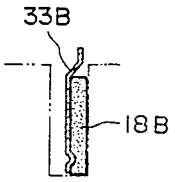

In FIG. 6B, another embodiment of the resilient padding is provided which has a groove to match a corresponding groove in the contact tongue 33B, to better the gripping there-between to prevent accidental slippage.

Figure 1:
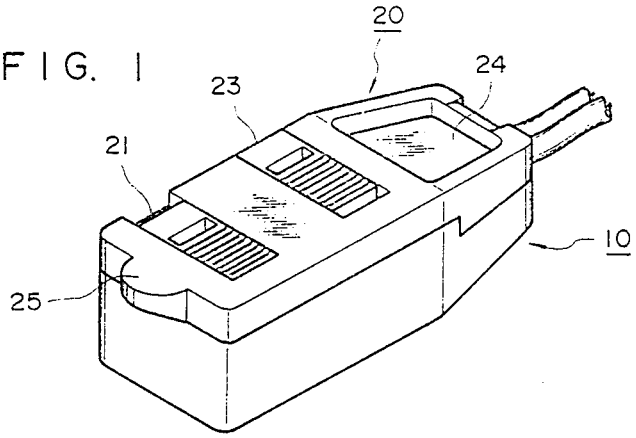
FIG. 1 is a perspective view of the electrical connector of a preferred embodiment of the present invention.
Figure 2:
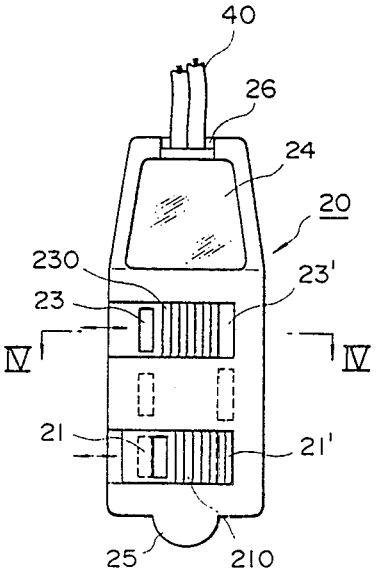
FIG. 2 is a top view of the connector.
Figure 3:
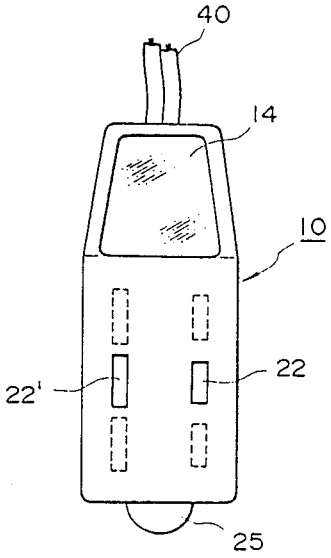
FIG. 3 is a bottom view of the same embodiment.

Projected pins 151–154, 16 and protruding rib 17 arising from the upper side of the housing 10 match corresponding recesses (not shown) formed underside the cover 20 for interlocking engagement of the two portions to achieve a proper alignment. In the top surface of the cover 10, slot pairs 21(small)—21'(big), 23(small)—23'(big) are provided, so that the small-big pair of the slots is to facilitates the polarized plug prongs. In a likewise manner, slot pair 22(small)—22'-(big) is provided at the bottom surface of the housing 10. These features can be clearly seen from FIGS. 2 and 3. Further refers to FIGS. 1 and 4, sliding doors 230, 210 are provided for the slot pairs 23—23' and 21—21'. In FIGS. 1 and 2, each door 230 (210) is provided with at least one slot corresponding to the position 23 and 21 (left end), door 230 being in an open position (re also FIGS. 4A and 4B) with both slots 23, 23' shown for plug-in service; while door 210 is in a closed position (also re FIG. 4C) both slots 21, 21' are covered up. The sliding doors should be made tight enough to prevent accidental opening.

Tab 25 on the cover 20 facilitates the opening. Recesses 14 and 15 are for weight reduction.

I claim:

1. An electrical connector of the type including a housing, a cover, a plurality of plug-in receptacles for insertion of the prongs and a plurality of contact strips, the improvement which comprises a housing of generally cubical form, a cover matchable with said housing, a plurality of plug-in receptacles disposed within the housing for insertion of said prongs, plug-in openings provided on the surfaces of said housing and said cover, each cover opening being provided with a slidable door having at least one slot to selectively expose or cover-up each of said receptacles, and wherein each contact strip is provided with a resilient padding of plastic material to improve the gripping between each contact strip and each of said prongs.

2. The connector according to claim 1 wherein said padding is made of foam rubber.

3. The connector according to claim 1 wherein each contact strip is provided with a spring and with a resilient padding of plastic material to improve the gripping between said contact strip and said prong.

4. The connector according to claim 1 wherein the padding material is in block form, wedge form or a form with a groove and the contact strip has a groove which engages with said groove in the padding material.

* * * * *